US012693062B2

(12) United States Patent
Junge et al.

(10) Patent No.: US 12,693,062 B2
(45) Date of Patent: Jul. 28, 2026

(54) REFRIGERATOR APPLIANCE HAVING A DUAL-FLOW SEALED SYSTEM AND METHODS OF OPERATING THE SAME

(71) Applicant: Haier US Appliance Solutions, Inc., Wilmington, DE (US)

(72) Inventors: Brent Alden Junge, Louisville, KY (US); Michael Goodman Schroeder, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 117 days.

(21) Appl. No.: 18/615,696

(22) Filed: Mar. 25, 2024

(65) Prior Publication Data

US 2025/0297796 A1 Sep. 25, 2025

(51) Int. Cl.

| | |
|---|---|
| ***F25D 11/02*** | (2006.01) |
| ***F25B 1/00*** | (2006.01) |
| ***F25B 41/20*** | (2021.01) |

(52) U.S. Cl.

CPC ..... *F25D 11/022* (2013.01); *F25B 1/00* (2013.01); *F25B 41/20* (2021.01)

(58) Field of Classification Search

CPC ..... F25D 11/022; F25D 11/02; F25D 21/00; F25D 21/002; F25D 21/004; F25D 21/06; F25D 21/065; F25B 41/20; F25B 1/00; F25B 2400/0403; F25B 47/02; F25B 47/022; F25B 2347/02; F25B 2347/021

See application file for complete search history.

(56) References Cited

U.S. PATENT DOCUMENTS

| | | | | |
|---|---|---|---|---|
| 8,250,875 | B2 | 8/2012 | Rafalovich et al. | |
| 10,718,561 | B2 | 7/2020 | Cho et al. | |
| 10,746,455 | B2 | 8/2020 | Kim | |
| 2011/0185760 | A1* | 8/2011 | Suh | F25B 5/00 62/340 |
| 2012/0137724 | A1 | 6/2012 | Junge et al. | |
| 2012/0324918 | A1* | 12/2012 | Bortoletto | F25B 5/00 62/340 |
| 2013/0098076 | A1 | 4/2013 | Hegedus et al. | |

FOREIGN PATENT DOCUMENTS

| | | | |
|---|---|---|---|
| WO | WO2015043678 | A1 | 4/2015 |
| WO | WO2015062524 | A1 | 5/2015 |
| WO | WO2015062662 | A1 | 5/2015 |
| WO | WO2023287035 | A1 | 1/2023 |

* cited by examiner

*Primary Examiner* — Miguel A Diaz

(74) *Attorney, Agent, or Firm* — Dority & Manning, P.A.

(57) ABSTRACT

A refrigerator appliance may include a cabinet, a fresh food door, a freezer door, and a sealed refrigerant system. The cabinet may include an internal liner defining a freezer chamber and a fresh food chamber. The fresh food door may be attached to the cabinet to selectively restrict access to the fresh food chamber. The freezer door may be attached to the cabinet to selectively restrict access to the freezer chamber. The sealed refrigerant system may include a refrigerant loop, a compressor disposed along the refrigerant loop, a condenser disposed along the refrigerant loop downstream from the compressor, a freezer evaporator mounted at the freezer chamber in fluid communication between the condenser and the compressor, a fresh food evaporator mounted at the fresh food chamber in fluid communication between the condenser and the compressor, and a bypass valve or electric heating element disposed on the freezer evaporator.

18 Claims, 11 Drawing Sheets

REFRIGERATOR APPLIANCE HAVING A DUAL-FLOW SEALED SYSTEM AND METHODS OF OPERATING THE SAME

FIELD OF THE DISCLOSURE

The present subject matter relates generally to refrigerator appliances, and more particularly to refrigerators having dual evaporators.

BACKGROUND OF THE DISCLOSURE

Certain refrigerator appliances utilize sealed systems for cooling chilled chambers of the refrigerator appliances. A typical sealed system includes an evaporator and a fan, the fan generating a flow of air across the evaporator and cooling the flow of air. The cooled air is then provided through an opening into the chilled chamber to maintain the chilled chamber at a desired temperature. Air from the chilled chamber is circulated back through a return duct to be re-cooled by the sealed system during operation of the refrigerator appliance, maintaining the chilled chamber at the desired temperature.

Some refrigerator appliances have incorporated multiple different evaporators to separately cool air of multiple different chilled chambers. For instance, a freezer evaporator may be provided for a freezer chamber while a separate fresh food chamber is provided for a fresh food chamber. Although such systems may provide greater control over individual chilled chambers, issues may arise with existing appliances. For instance, in order to maintain the freezer chamber at a selected freezer temperature, instances may arise in which a fresh food evaporator is chilled beyond what is necessary to maintain a selected fresh food temperature. This may, in turn, reduce efficiency or otherwise increase the energy draw of the appliance. Attempts to raise the temperature of the fresh food evaporator may lead to undesirable refrigerant migration counter to the direction of configured flow (e.g., in an upstream direction instead of the configured downstream direction). For example, refrigerant may flow from the fresh food evaporator to the freezer chamber.

As a result, it would be useful to provide an appliance, method, or system configured to mitigate one or more of the above-identified issues.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a fresh food door, a freezer door, and a sealed refrigerant system. The cabinet may include an internal liner defining a freezer chamber and a fresh food chamber. The fresh food door may be attached to the cabinet to selectively restrict access to the fresh food chamber. The freezer door may be attached to the cabinet to selectively restrict access to the freezer chamber. The sealed refrigerant system may include a refrigerant loop, a compressor disposed along the refrigerant loop, a condenser disposed along the refrigerant loop downstream from the compressor, a freezer evaporator mounted at the freezer chamber in fluid communication between the condenser and the compressor, a fresh food evaporator mounted at the fresh food chamber in fluid communication between the condenser and the compressor, a bypass valve disposed along the refrigerant loop in fluid communication between the compressor and the condenser, and a bypass line extending from a bypass inlet at the bypass valve to a bypass outlet disposed on the refrigerant loop downstream from the condenser such that the bypass line is in fluid communication with the bypass valve to selectively direct a portion of refrigerant around the condenser.

In another exemplary aspect of the present disclosure, a refrigerator appliance is provided. The refrigerator appliance may include a cabinet, a fresh food door, a freezer door, and a sealed refrigerant system. The cabinet may include an internal liner defining a freezer chamber and a fresh food chamber. The fresh food door may be attached to the cabinet to selectively restrict access to the fresh food chamber. The freezer door may be attached to the cabinet to selectively restrict access to the freezer chamber. The sealed refrigerant system may include a refrigerant loop, a compressor disposed along the refrigerant loop, a condenser disposed along the refrigerant loop downstream from the compressor, a multi-path valve disposed along the refrigerant loop downstream from the condenser, a freezer evaporator mounted at the freezer chamber and disposed along a first branch path in selective fluid communication between the multi-path valve and the compressor, a fresh food evaporator mounted at the fresh food chamber and disposed along a second branch path in selective fluid communication between the multi-path valve and the compressor, a bypass valve disposed along the refrigerant loop in fluid communication between the compressor and the condenser, and a bypass line extending from a bypass inlet at the bypass valve to a bypass outlet disposed on the refrigerant loop downstream from the condenser such that the bypass line is in fluid communication with the bypass valve to selectively direct a portion of refrigerant around the condenser.

In yet another exemplary aspect of the present disclosure, a refrigerator appliance is provided. The refrigerator appliance may include a cabinet, a fresh food door, a freezer door, and a sealed refrigerant system. The cabinet may include an internal liner defining a freezer chamber and a fresh food chamber. The fresh food door may be attached to the cabinet to selectively restrict access to the fresh food chamber. The freezer door may be attached to the cabinet to selectively restrict access to the freezer chamber. The sealed refrigerant system may include a refrigerant loop, a compressor disposed along the refrigerant loop, a condenser disposed along the refrigerant loop downstream from the compressor, a multi-path valve disposed along the refrigerant loop downstream from the condenser, a freezer evaporator mounted at the freezer chamber and disposed along a first branch path in selective fluid communication between the multi-path valve and the compressor, a fresh food evaporator mounted at the fresh food chamber and disposed along a second branch path in selective fluid communication between the multi-path valve and the compressor, and an electric heating element disposed on the freezer evaporator, the electric heating element being configured to selectively heat refrigerant at the freezer evaporator and thereby enable elevated refrigerant temperatures at the fresh food evaporator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
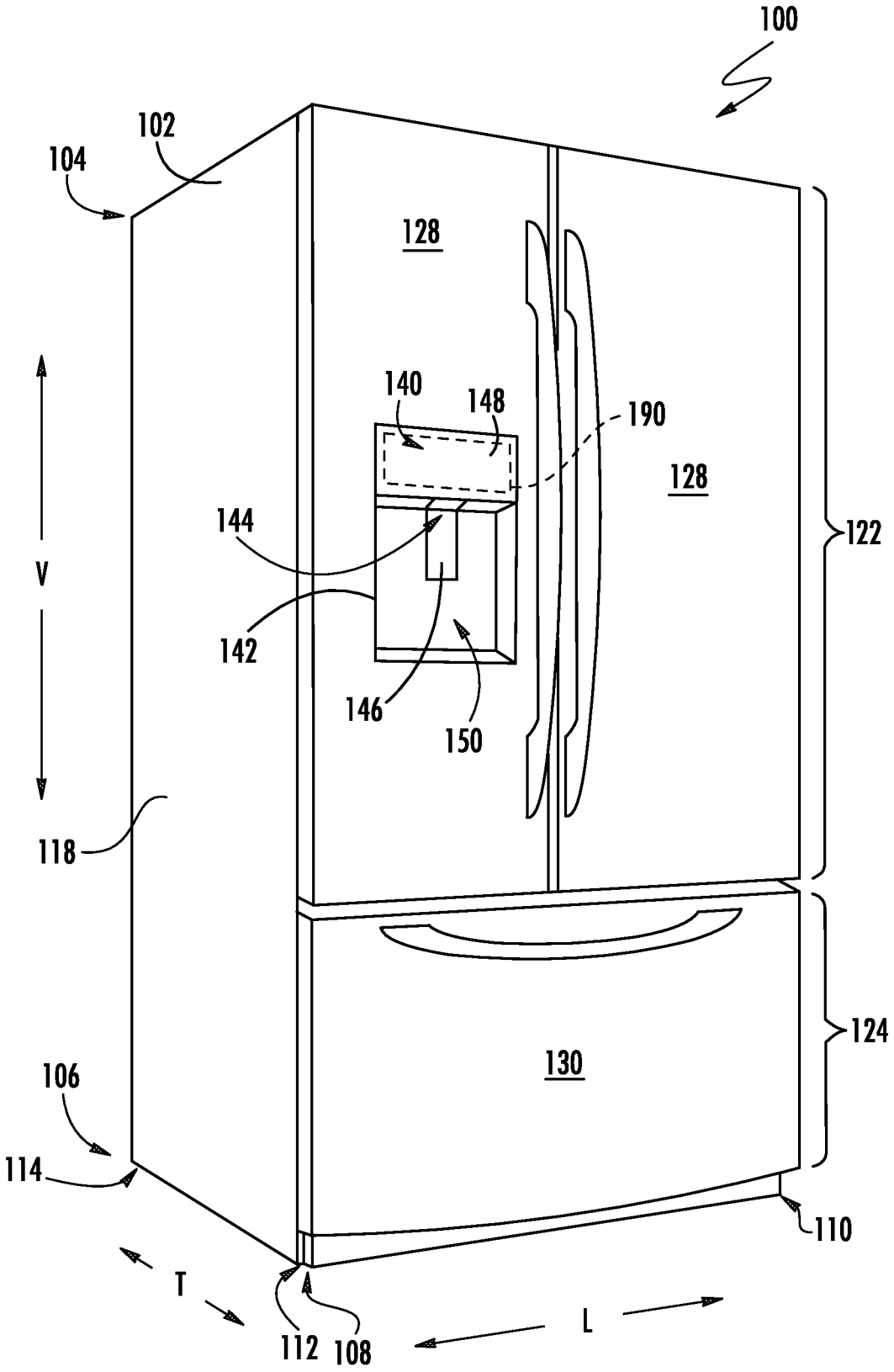
FIG. 1 provides a perspective view of a refrigerator appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Generally, a refrigerator appliance may be provided in some aspects of the present disclosure. The refrigerator appliance can include multiple chambers cooled by a sealed refrigerant system. The system can have multiple evaporators to separately cool the multiple chambers. At least one of the evaporators may be able to operate at a relatively high temperature (e.g., above −10° Fahrenheit, such as between 5° and 10° Fahrenheit) without risking the backflow of refrigerant to another evaporator. For instance, one or more features, such as a refrigerant bypass line or heating element, can be provided to heat portions of the system or refrigerant. Notably, a flow-restricting element, such as a check valve, may be avoided or absent from the sealed refrigerant system, which may prevent inefficiencies within the system that might otherwise occur. The presently disclosed appliance or sealed refrigerant may facilitate improvements in efficiency in upwards of 5% (e.g., in comparison to existing systems).

Figure 2:
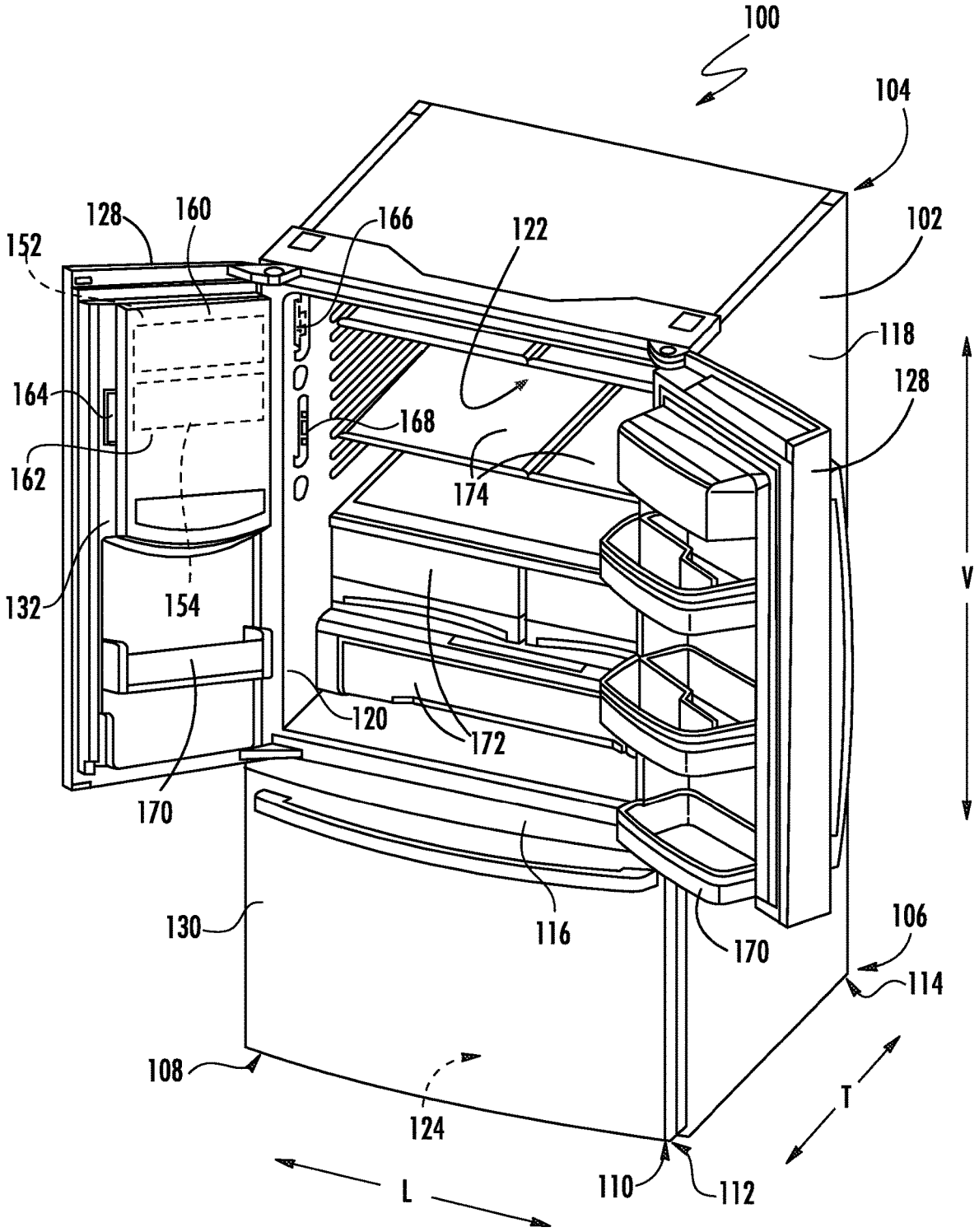
FIG. 2 provides a perspective view of the example refrigerator appliance shown in FIG. 1, wherein a refrigerator door is in an open position according to an exemplary embodiments of the present disclosure.

Turning to the figures, FIGS. 1 and 2 illustrate perspective views of an exemplary refrigerator appliance 100. Refrigerator appliance 100 includes a housing or cabinet 102 having an outer liner 118. As shown, cabinet generally extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

As shown, cabinet 102 generally defines chilled chambers for receipt of food items for storage. In particular, cabinet 102 defines fresh food chamber 122 proximal to adjacent top 104 of cabinet 102 and a freezer chamber 124 arranged proximal to 106 of cabinet 102. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are positioned to receive of food items (e.g., beverages or solid food items) and may assist with organizing such food items. As an example, drawers 172 can receive fresh food items (e.g., vegetables, fruits, or cheeses) and increase the useful life of such fresh food items. In some embodiments, a lateral mullion 116 is positioned within cabinet 102 and separating freezer chamber 124 and the fresh food chamber 122 along a vertical direction V.

Refrigerator doors 128 are rotatably hinged to an edge of cabinet 102 for selectively accessing fresh food chamber 122 and extending across at least a portion of fresh food chamber 122. In addition, a freezer door 130 is arranged below refrigerator doors 128 for selectively accessing freezer chamber 124 and extending across at least a portion of freezer chamber 124. Freezer door 130 is coupled to a freezer drawer (not shown) slidably mounted within freezer chamber 124. Refrigerator doors 128 and freezer door 130 are each shown in the closed position in FIG. 1 (i.e., a first closed position corresponding to doors 128, and a second closed position corresponding to door 130).

In optional embodiments, refrigerator appliance 100 includes a delivery assembly 140 for delivering or dispensing liquid water or ice. Delivery assembly 140 includes a dispenser 142 positioned on or mounted to an exterior portion of refrigerator appliance 100 (e.g., on one of refrigerator doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for directing (e.g., selecting) the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In exemplary embodiments, dispenser recess 150 is positioned at a level that approximates the chest level of a user. During certain operations, the dispensing assembly 140 may receive ice from an icemaker 152 mounted in a sub-compartment of the fresh food chamber 122, as described below.

Operation of the refrigerator appliance 100 can be generally controlled or regulated by a controller 190. In some embodiments, controller 190 is operably coupled (e.g., electrically coupled or wirelessly coupled) to user interface panel 148 or various other components. In some such embodiments, user interface panel 148 provides selections for user manipulation of the operation of refrigerator appliance 100. As an example, user interface panel 148 may provide for selections between whole or crushed ice, chilled water, a specific temperature of operation for either chilled chamber 122, 124, or specific modes of operation. In response to one or more input signals (e.g., from user manipulation of user interface panel 148 or one or more sensor signals), controller 190 may operate various components of the refrigerator appliance 100 according to the current mode of operation (e.g., execute an operation routine including the example method 300 described below with reference to FIG. 11).

Controller 190 may include a memory (e.g., non-transitory storage media) and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. For certain embodiments, the instructions include a software package configured to operate appliance 100 and, for example, execute an operation routine. The memory may be a separate component from the processor or may be included onboard within the processor. Alternatively, controller 190 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

Controller 190, or portions thereof, may be positioned in a variety of locations throughout refrigerator appliance 100.

In exemplary embodiments, controller 190 is located within the user interface panel 148. In other embodiments, the controller 190 may be positioned at any suitable location within refrigerator appliance 100, such as for example within the fresh food chamber 122, a freezer door 130, etc. Input/output (i.e., "I/O") signals may be routed between controller 190 and various operational components of refrigerator appliance 100. For example, user interface panel 148 may be operably coupled to controller 190 via one or more signal lines or shared communication busses.

Figure 3:
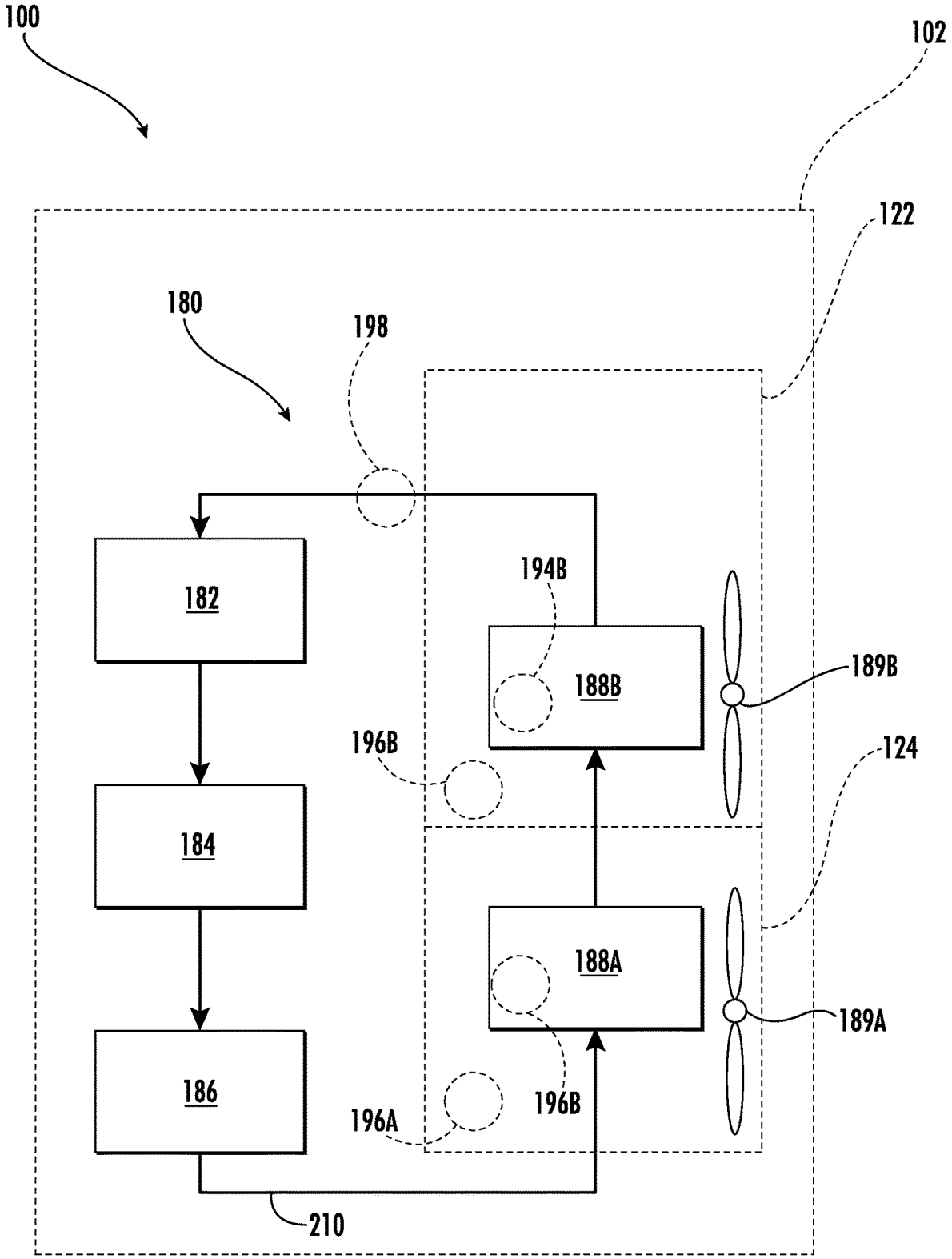
FIG. 3 provides a schematic view of a refrigerator appliance, including a cooling system, according to exemplary embodiments of the present disclosure.

As illustrated, controller 190 may be operably coupled to the various components of appliance 100 and may control operation of the various components, such as one or more temperature sensors 194, air handlers 189A, 189B, as well as one or more components of a sealed cooled system 180 (see FIG. 3). For example, various sensors, switches, valves, fans, compressor, etc. may be actuatable or selectively activated based on commands from the controller 190. As discussed, interface panel 148 may additionally be operably coupled to the controller 190. Thus, the various operations may occur based on user input or automatically through controller 190 instruction.

FIG. 2 provides a perspective view of refrigerator appliance 100 shown with refrigerator doors 128 in the open position. In optional embodiments, a secondary liner (e.g., icebox liner 132) defining a sub-compartment (e.g., icebox compartment 160) is attached (e.g., mechanically connected directly or indirectly) to cabinet 102. For instance, in some embodiments, at least one door 128 includes icebox liner 132 positioned thereon. In turn, icebox compartment 160 is defined within one of doors 128. Nonetheless, additional or alterative embodiments may include an icebox compartment defined at another portion of refrigerator appliance 100 (e.g., within door 130 or fresh food chamber 122). An ice making assembly or icemaker 152 may be positioned or mounted within icebox compartment 160. Ice may be supplied to dispenser recess 150 (FIG. 1) from the icemaker 152 in icebox compartment 160 on a back side of refrigerator door 128.

An access door (e.g., icebox door 162 having a suitable latch 164) may be hinged to icebox compartment 160 to selectively cover or permit access to opening of icebox compartment 160. Optionally, the icebox compartment 160 may receive cooling air from a chilled air supply duct 166 and a chilled air return duct 168 positioned on a side portion of cabinet 102 of refrigerator appliance 100. Additionally or alternatively, an icemaker 152 and ice bucket or storage bin 154 are provided within icebox compartment 160.

Turning now to FIG. 3, a schematic view of certain components of a sealed cooling system 180 for refrigerator appliance 100 is provided. As may be seen in FIG. 3, refrigerator appliance 100 includes a sealed cooling system 180 for executing a vapor compression cycle for cooling air within refrigerator appliance 100 (e.g., within fresh food chamber 122 and freezer chamber 124). Sealed cooling system 180 generally includes a compressor 182, a condenser 184, one or more expansion devices 186, and one or more evaporators 188A, 188B connected in fluid communication on a refrigerant loop 210 and charged with a refrigerant. As will be understood by those skilled in the art, sealed cooling system 180 may include additional or fewer components.

Within sealed cooling system 180, gaseous refrigerant flows into compressor 182, which operates to increase the pressure of the refrigerant. This compression of the refrigerant raises its temperature, which is lowered by passing the gaseous refrigerant through condenser 184. Within condenser 184, heat exchange (e.g., with ambient air) takes place so as to cool the refrigerant and cause the refrigerant to condense to a liquid state.

Expansion device(s) 186 (e.g., a valve, capillary tube, or other restriction device) receives liquid refrigerant from condenser 184. From expansion device 186, the liquid refrigerant enters evaporator 188A or evaporator 188B. In some embodiments, one evaporator 188A is mounted at or within freezer chamber 124 while another evaporator 188B is mounted at or within fresh food chamber 122. Upon exiting an expansion device 186 and entering one or more evaporator(s) 188A, 188B, the liquid refrigerant drops in pressure and vaporizes. Due to the pressure drop and phase change of the refrigerant, evaporators 188A, 188B are cool relative to freezer and fresh food chambers 124 and 122 of refrigerator appliance 100. As such, cooled air is produced and refrigerates freezer and fresh food chambers 124 and 122 of refrigerator appliance 100. Thus, evaporators 188A, 188B are heat exchangers that transfer heat from air passing over evaporators 188A, 188B to refrigerant flowing through evaporators 188A, 188B. In some embodiments, an air handler 189A or 189B, such as a fan or blower, is provided adjacent to one or more of evaporators 188A, 188B. For instance, air handler 189A may be provided within freezer chamber 124 to motivate air across evaporator 188A. Additionally or alternatively, air handler 189B may be provided within fresh food chamber 122 to motivate air across evaporator 188B.

As illustrated, one or more temperature sensors may be mounted on or adjacent to various portions of the sealed cooling system 180. For instance, one or more of the evaporators 188A, 188B may have a corresponding evaporator temperature sensor 194A, 194B attached or directed to the evaporator 188A or 188B to detect a temperature of the same (e.g., as a direct or, alternatively, indirect measurement of refrigerant within the evaporator 188A or 188B). Additionally or alternatively, one or more chamber temperature sensors 196A, 196B may be mounted within a corresponding chilled chamber 124, 122 to detect a temperature of the same (e.g., as a direct or, alternatively, indirect measurement of air temperature within the chilled chamber 124 or 122). Further additionally or alternatively, or more loop temperature sensors 198 may be attached or directed to the refrigerant loop 210 (e.g., along the loop between the evaporators 188A, 188B and the compressor 182 relative to the direction of refrigerant flow) to detect a temperature of the same (e.g., as a direct or, alternatively, indirect measurement of refrigerant within the refrigerant loop 210).

Generally, the temperature sensor(s) 194A, 194B, 196A, 196B, 198 may include or be provided as any suitable device for detecting or measuring temperature, such as a thermistor or thermocouple. Moreover, the temperature sensor(s) may be operably (e.g., electrically or wirelessly) coupled to controller 190 such that temperatures detected or measured at a particular sensor are communicated to controller 190 to influence operation of sealed system 180 (or appliance 100 generally).

Turning now further to FIGS. 4 through 10, schematic views are provided of various portions and implements of sealed system 180 according to exemplary embodiments of the present disclosure.

As noted above, compressor 182, condenser 184, freezer evaporator 188A, and fresh food evaporator 188B are provided along refrigerant loop 210 to guide or motivate a refrigerant through the refrigerant loop 210. In particular, considering a single circuit or lap of the refrigerant loop 210 (e.g., from an exit of a single element, such as the compressor 182, to an entry of the same single element), condenser 184 may be disposed along refrigerant loop 210 downstream from compressor 182. Freezer evaporator 188A may be mounted in fluid communication between condenser 184 and compressor 182 (e.g., downstream from condenser 184 and upstream from compressor 182). Moreover, fresh food evaporator 188B may be mounted in fluid communication between condenser 184 and compressor 182 (e.g., downstream from condenser 184 and upstream from compressor 182).

In some embodiments, refrigerant can be selectively directed through the refrigerant loop 210 to freezer evaporator 188A or fresh food evaporator 188B (e.g., alternately). For instance, a multi-path valve 212 may selectively alter or adjust at least a portion of refrigerant flow upstream from freezer evaporator 188A or fresh food evaporator 188B. Generally, any suitable (e.g., three-way) valve for altering or selectively redirecting fluid flow may be provided. Optionally, multi-path valve 212 may be operably coupled to controller 190 (FIG. 1), such that the position of flow direction of multi-path valve 212 may be dictated or directed according to instructions from controller 190. As shown, multi-path valve 212 may be disposed along the refrigerant loop 210 downstream from the condenser 184 and upstream from one or both evaporators 188A, 188B. From multi-path valve 212, multiple discrete branch paths of the refrigerant loop 210 may be defined as parallel or alternate flow paths to be selected at multi-path valve 212. In some embodiments, freezer evaporator 188A is disposed along a first branch path 222 in (e.g., selective) fluid communication between the multi-path valve 212 and the compressor 182. In additional or alternative embodiments, fresh food evaporator 188B is disposed along a second branch path 224 in selective fluid communication between the multi-path valve 212 and the compressor 182.

Turning generally to FIGS. 4 through 9, a bypass valve 214 and downstream bypass line 216 may be provided on refrigerant loop 210 to permit relatively hot volumes of refrigerant to bypass one or more portions of sealed system 180 (e.g., condenser 184). As shown, bypass valve 214 may be disposed along the refrigerant loop 210 in fluid communication between the compressor 182 and the condenser 184 (e.g., downstream from compressor 182 and upstream from condenser 184). Generally, any suitable (e.g., electronic expansion valve or solenoid valve) valve for altering or selectively redirecting the relatively hot fluid flow from compressor 182 may be provided. Optionally, bypass valve 214 may be operably coupled to controller 190 (FIG. 1), such that the position of flow direction of bypass valve 214 may be dictated or directed according to instructions from controller 190.

As noted, bypass line 216 may generally bypass condenser 184. In particular, bypass line 216 may extend from a line or bypass inlet 218 at bypass valve 214 to a bypass outlet 220 that is disposed on the refrigerant loop 210 downstream from the condenser 184. Thus, bypass line 216 may be in fluid communication with the bypass valve 214 to selectively direct a portion of refrigerant around the condenser 184. For instance, the position of bypass valve 214 may be switched such that at least a portion of the hot vapor flowing from compressor 182 toward condenser 184 is redirected to instead flow through the bypass line 216 and to bypass outlet 220 instead of flowing directly to condenser 184.

Figure 4:
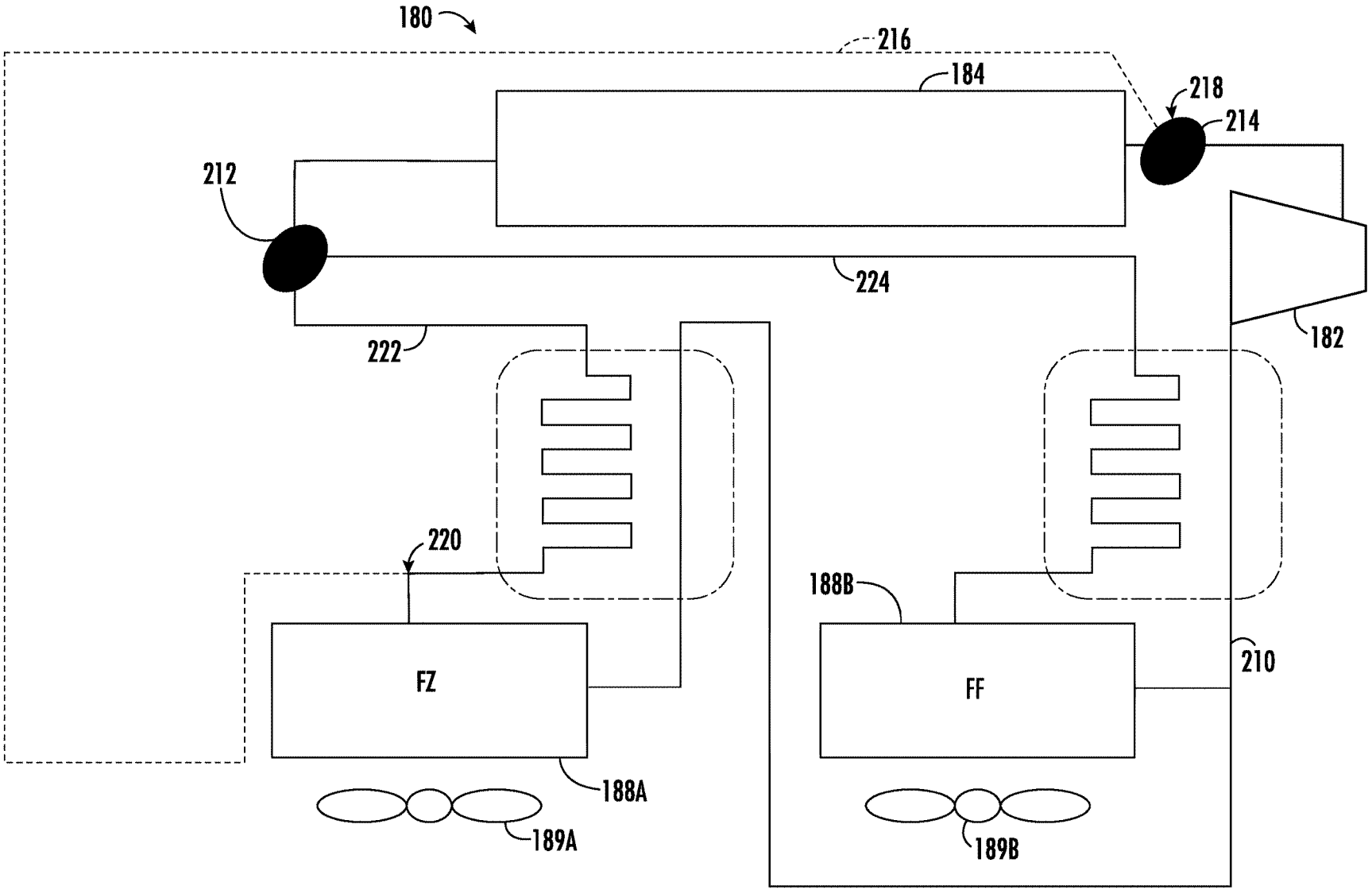
FIG. 4 provides a schematic view of a sealed cooling system of a refrigerator appliance according to exemplary embodiments of the present disclosure.

Turning especially to FIG. 4, bypass outlet 220 may be disposed downstream from multi-path valve 212. For instance, bypass outlet 220 may be disposed along the first branch path 222. As shown, bypass outlet 220 may further be upstream from the freezer evaporator 188A. Moreover, bypass outlet 220 (and thus bypass line 216) may bypass fresh food evaporator 188B. In some such embodiments, first branch path 222 and second branch path 224 are mounted in fluid parallel (e.g., upstream from compressor 182). Thus, the hot vapor refrigerant from compressor 182 may selectively flow to first branch path 222 and freezer evaporator 188A, before bypassing fresh food evaporator 188B and flowing back to compressor 182.

Figure 5:
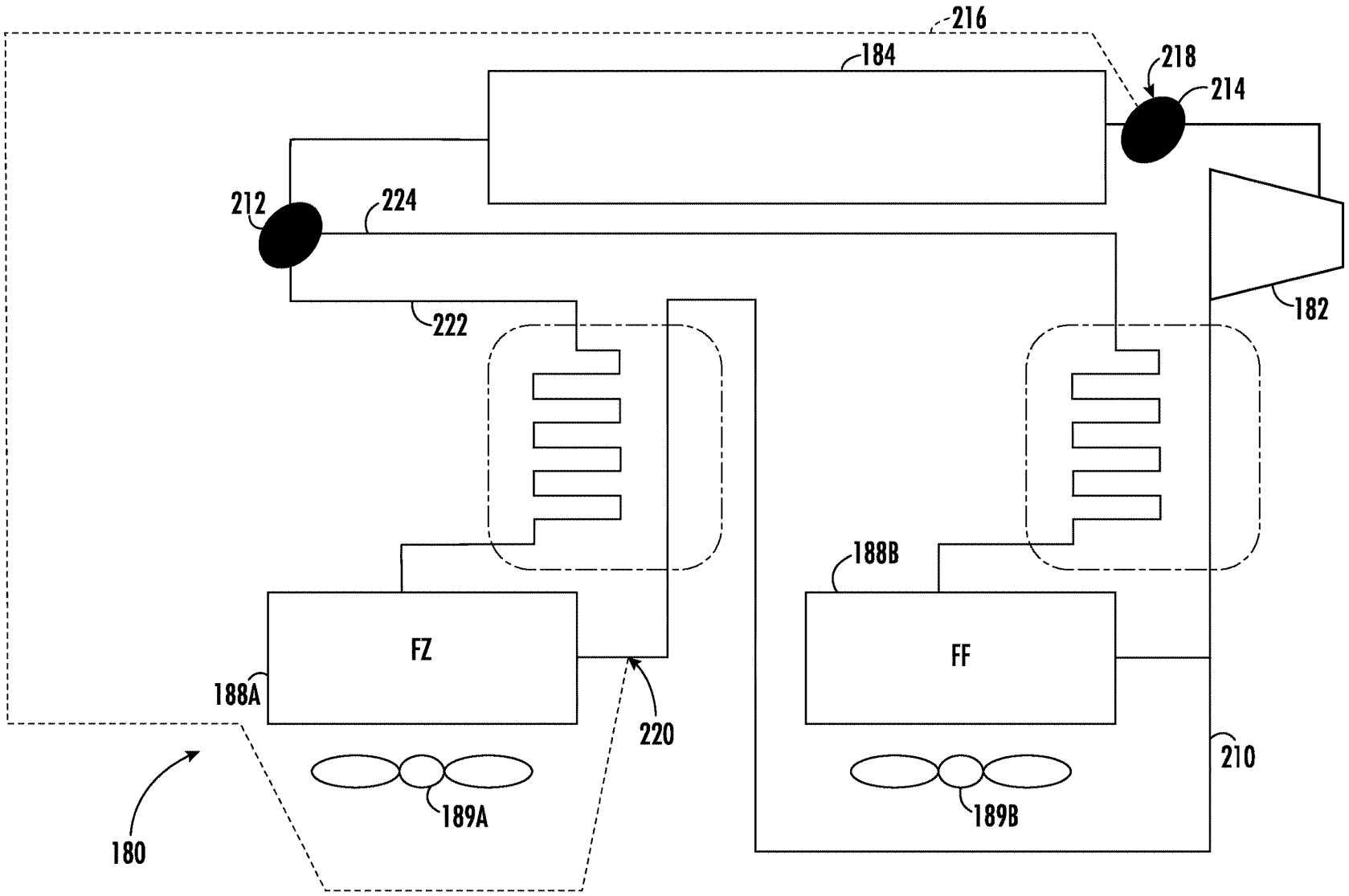
FIG. 5 provides a schematic view of a sealed cooling system of a refrigerator appliance according to exemplary embodiments of the present disclosure.

Turning especially to FIG. 5, bypass outlet 220 may be disposed downstream from multi-path valve 212. For instance, bypass outlet 220 may be disposed along the first branch path 222. As shown, bypass outlet 220 may further be downstream from the freezer evaporator 188A. Moreover, bypass outlet 220 (and thus bypass line 216) may bypass fresh food evaporator 188B. In some such embodiments, first branch path 222 and second branch path 224 are mounted in fluid parallel (e.g., upstream from compressor 182). The bypass outlet 220 may be upstream from a junction between the first branch path 222 and second branch path 224. Thus, the hot vapor refrigerant from compressor 182 may selectively flow to first branch path 222 and bypass both freezer evaporator 188A and fresh food evaporator 188B before flowing back to compressor 182.

Figure 6:
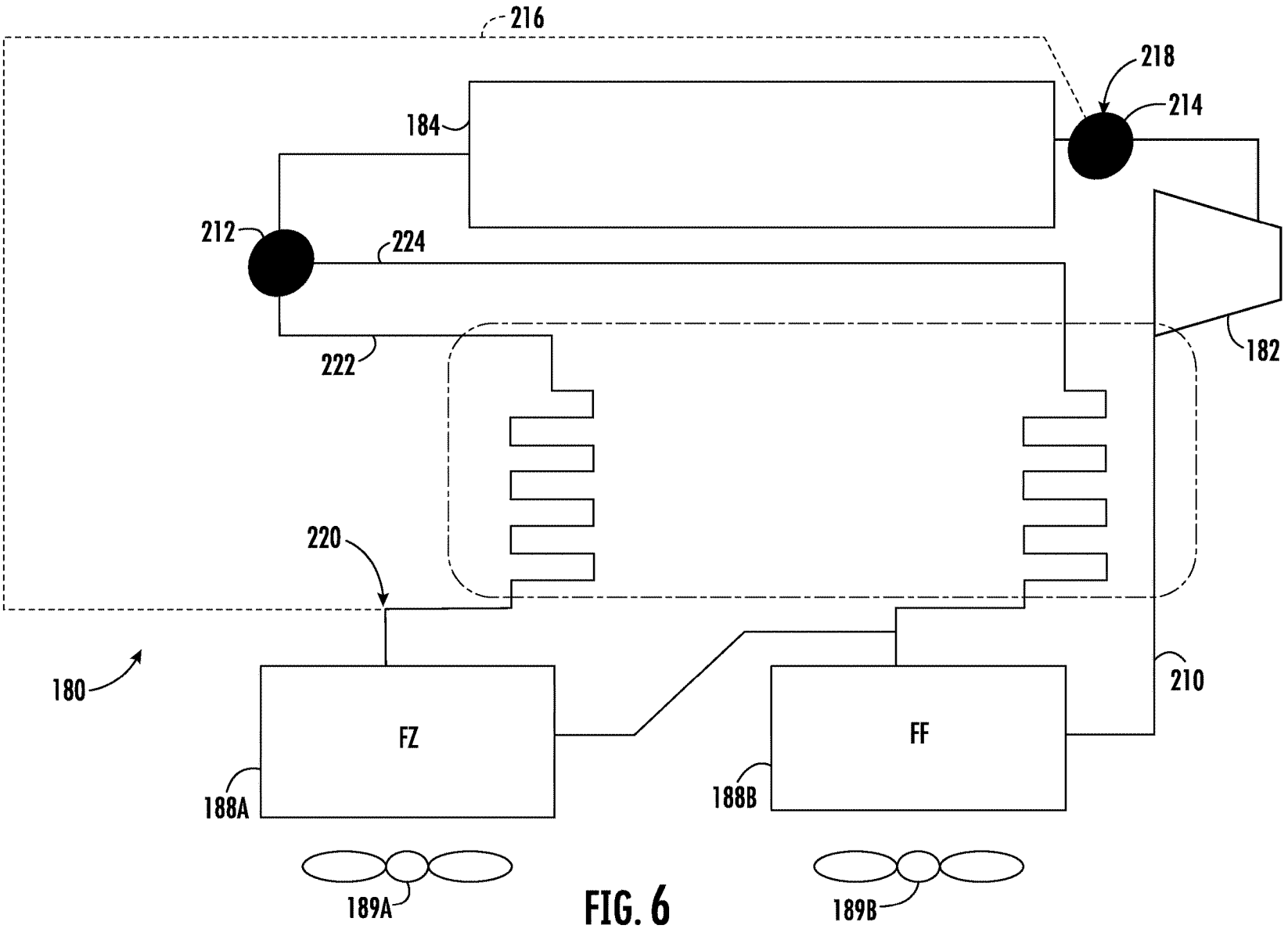
FIG. 6 provides a schematic view of a sealed cooling system of a refrigerator appliance according to exemplary embodiments of the present disclosure.

Turning especially to FIG. 6, bypass outlet 220 may be disposed downstream from multi-path valve 212. For instance, bypass outlet 220 may be disposed along the first branch path 222. As shown, bypass outlet 220 may further be upstream from the freezer evaporator 188A. Moreover, bypass outlet 220 (and thus bypass line 216) may also be upstream from fresh food evaporator 188B. In some such embodiments, first branch path 222 intersects second branch path 224. Specifically, first branch path 222 may be disposed upstream from fresh food evaporator 188B. Thus, the hot vapor refrigerant from compressor 182 may selectively flow to first branch path 222 and freezer evaporator 188A, before flowing to fresh food evaporator 188B and back to compressor 182.

Figure 7:
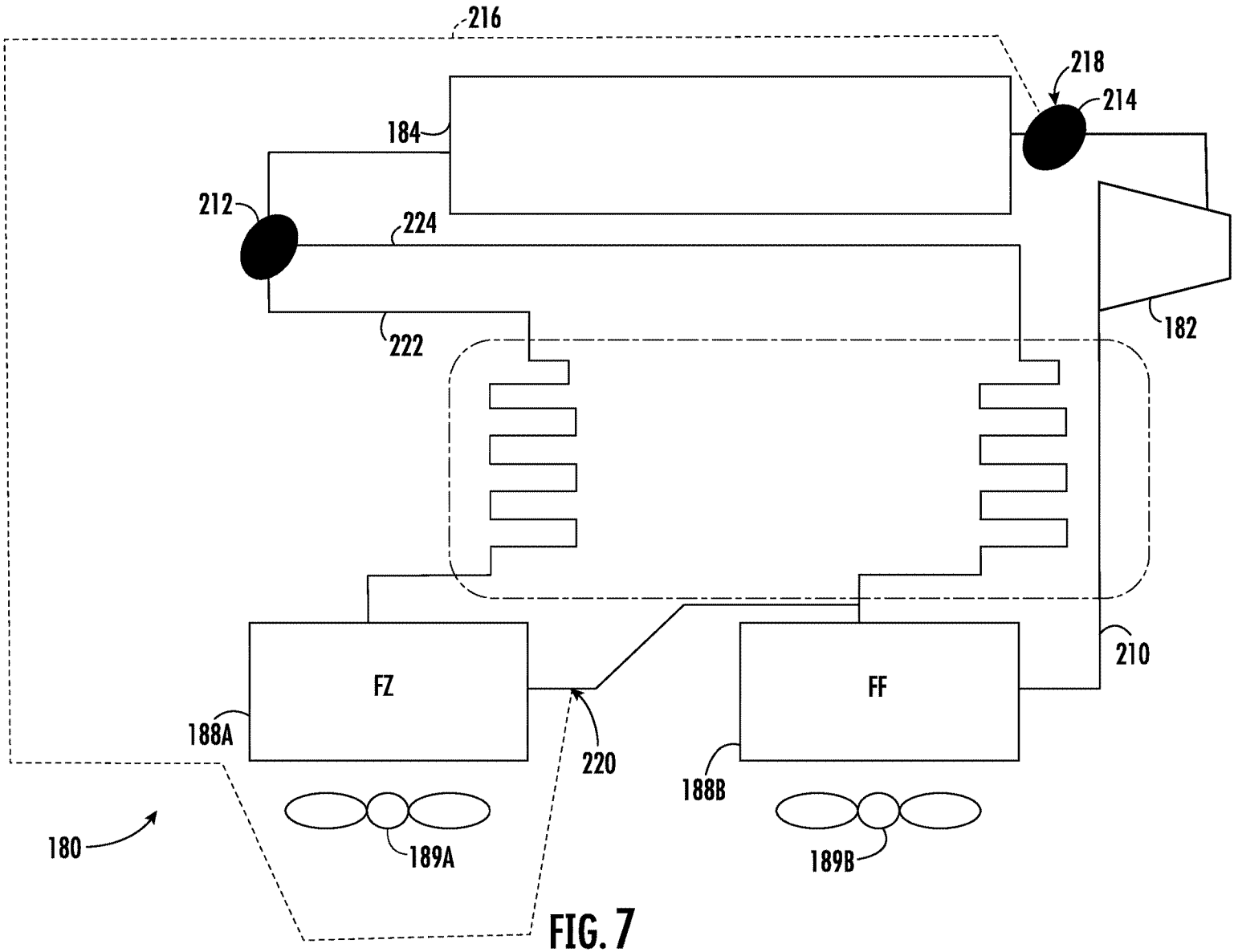
FIG. 7 provides a schematic view of a sealed cooling system of a refrigerator appliance according to exemplary embodiments of the present disclosure.

Turning especially to FIG. 7, bypass outlet 220 may be disposed downstream from multi-path valve 212. For instance, bypass outlet 220 may be disposed along the first branch path 222. As shown, bypass outlet 220 may further be downstream from the freezer evaporator 188A. Moreover, bypass outlet 220 (and thus bypass line 216) may also be upstream from fresh food evaporator 188B. In some such embodiments, first branch path 222 intersects second branch path 224. Specifically, first branch path 222 may be disposed upstream from fresh food evaporator 188B. Thus, the hot vapor refrigerant from compressor 182 may selectively flow to first branch path 222 and fresh food evaporator 188B, thereby bypassing freezer evaporator 188A before flowing back to compressor 182. The hot vapor refrigerant from compressor 182 may flow to freezer evaporator 188A because the evaporator temperature and therefore the vapor pressure is lower than in the fresh food evaporator 188B.

Figure 8:
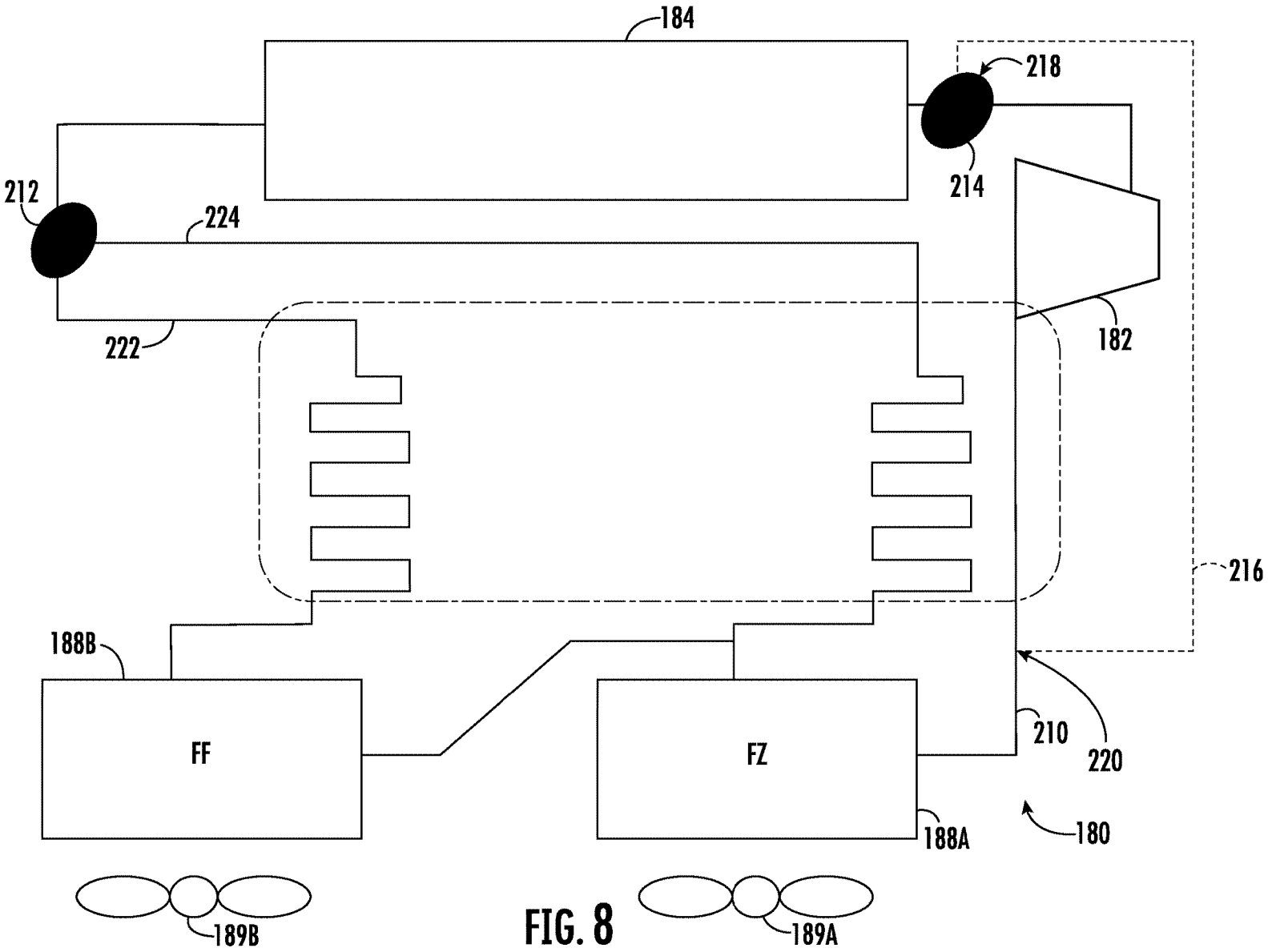
FIG. 8 provides a schematic view of a sealed cooling system of a refrigerator appliance according to exemplary embodiments of the present disclosure.

Turning especially to FIG. 8, bypass outlet 220 may be disposed downstream from multi-path valve 212. For instance, bypass outlet 220 may be disposed along the second branch path 224. As shown, bypass outlet 220 may further be downstream from the fresh food evaporator 188B. Moreover, bypass outlet 220 (and thus bypass line 216) may also be upstream from fresh food evaporator 188B. In some such embodiments, first branch path 222 intersects second branch path 224. Specifically, first branch path 222 may be disposed upstream from fresh food evaporator 188B. Thus, the hot vapor refrigerant from compressor 182 may selectively flow to second branch path 224 and bypass both freezer evaporator 188A and fresh food evaporator 188B before flowing back to compressor 182.

Figure 9:
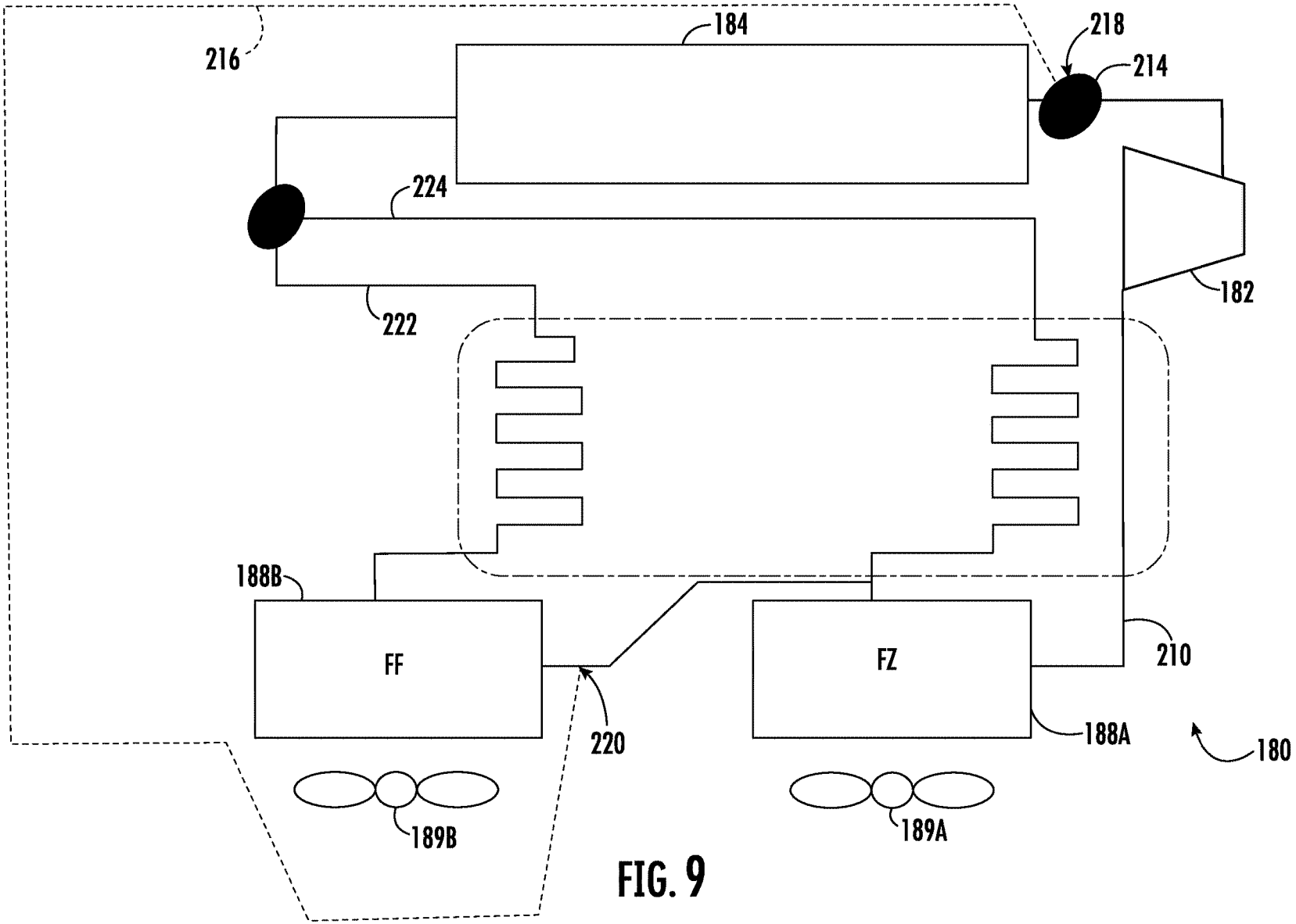
FIG. 9 provides a schematic view of a sealed cooling system of a refrigerator appliance according to exemplary embodiments of the present disclosure.

Turning especially to FIG. 9, bypass outlet 220 may be disposed downstream from multi-path valve 212. For instance, bypass outlet 220 may be disposed along the second branch path 224. As shown, bypass outlet 220 may further be downstream from the fresh food evaporator 188B. Moreover, bypass outlet 220 (and thus bypass line 216) may also be upstream from freezer evaporator 188A. In some such embodiments, second branch path 224 intersects first branch path 222. Specifically, second branch path 224 may be disposed upstream from freezer evaporator 188A. Thus, the hot vapor refrigerant from compressor 182 may selectively flow to second branch path 224 and freezer evaporator 188A, thereby bypassing fresh food evaporator 188B before flowing back to compressor 182.

Figure 10:
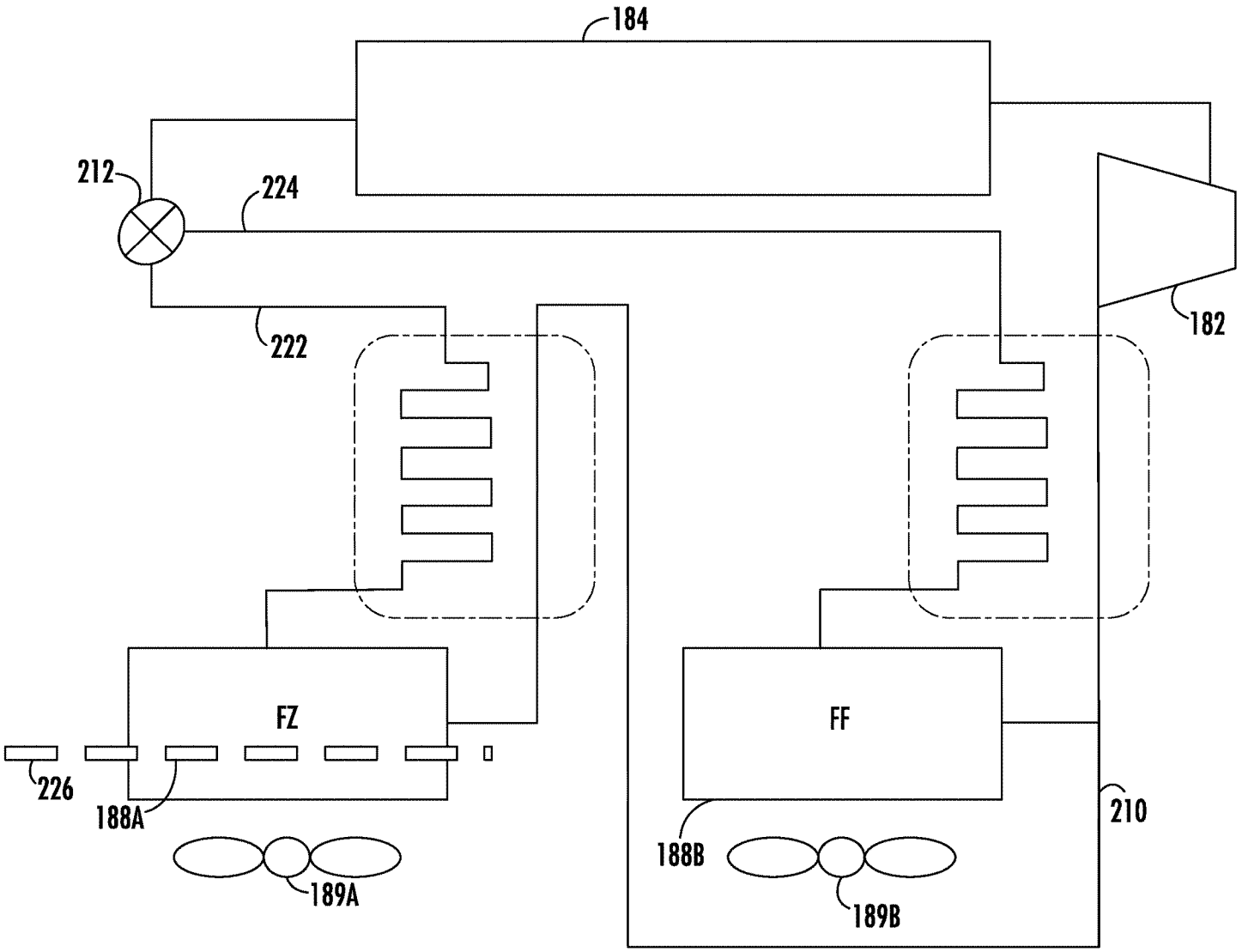
FIG. 10 provides a schematic view of a sealed cooling system of a refrigerator appliance according to exemplary embodiments of the present disclosure.

Turning now to FIG. 10, in some embodiments, an electric heating element 226 is provided along refrigerant loop 210. For instance, electric heating element 226 may be disposed on freezer evaporator 188A. Electric heating element 226 may generally be provided as any suitable electrically driven heater, such as a resistive heating element, halogen heating element, etc. In turn, electric heating element 226 may be configured to selectively generate heat at freezer evaporator 188A, thereby heating refrigerant at the same. For instance, electric heating element 226 may be operably coupled to controller 190 to receive instructions or an electrical current from the same. In some such embodiments, first branch path 222 and second branch path 224 are mounted in fluid parallel (e.g., upstream from compressor 182). During use, electric heating element 226 may be selectively activated to heat refrigerant, thereby notably permitting or enabling elevated refrigerant temperatures at the fresh food evaporator 188B (e.g., without risking refrigerant migration from fresh food evaporator 188B to freezer evaporator 188A counter to the above-described direction of refrigerant flow).

Figure 11:
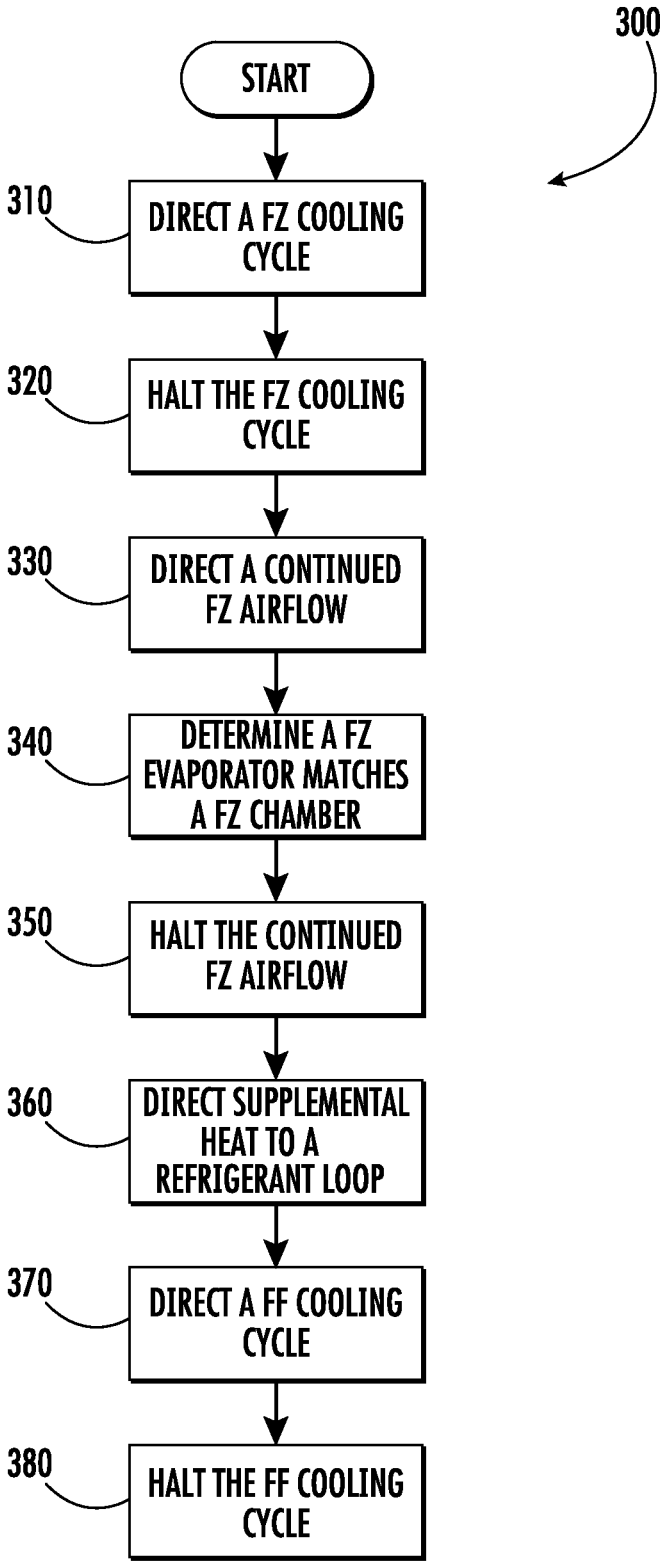
FIG. 11 provides a flow chart illustrating a method of operating a refrigerator appliance according to exemplary embodiments of the present disclosure.

Turning now to FIG. 11, a flow chart is provided of a method 300 according to example embodiments of the present disclosure. Generally, the method 300 provides for methods of operating a refrigeration appliance (e.g., 100) that includes a sealed refrigerant or cooling system (e.g., 180), as described above. The method 300 can be performed, for instance, by the controller 190 (FIG. 1). For example, controller 190 may, as discussed, be operably coupled to a compressor 182, one or more valves 212, 214, temperature sensors 194A, 194B, 196A, 196B, 198, or heating elements 226. During operations, controller 190 may send signals to and receive signals from the compressor 182, one or more valves 212, 214, temperature sensors 194A, 194B, 196A, 196B, 198, or heating elements 226. Controller 190 may further be operably coupled to other suitable components of the appliance 100 to facilitate operation of the appliance 100 generally. FIG. 11 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure.

At 310, the method 300 includes directing a freezer cooling cycle. For instance, the compressor may be activated to compress or motivate refrigerant along the refrigerant loop (e.g., to perform a cooling cycle as described above). During such activation, the multi-path valve may be directed to open the branch path on which the freezer evaporator is disposed (e.g., in a first-branch-open position), thereby ensuring at least a portion of the refrigerant within the loop flows to and through the freezer evaporator. Additionally or alternatively, the bypass valve may be directed to close the bypass line (e.g., if present). Further additionally or alternatively, the electric heating element (e.g., if present) may be directed to or held in an inactive state (e.g., such that no heat is generated by the electric heating element). Moreover, the freezer fan may be activated to motivate air (e.g., as a freezer airflow) across the freezer evaporator or otherwise circulate through or within the freezer chamber.

As would be understood, the freezer cooling cycle may include one or more set parameters (e.g., targets or variable conditions), such as one or more compressor speeds, fan speeds, predetermined run times, etc. that the sealed system will use to execute the cooling cycle (e.g., in order to achieve a selected temperature within the freezer chamber).

At 320, the method 300 includes halting the freezer cooling cycle. In particular, the refrigerant flow through the freezer evaporator may be halted. The active flow of refrigerant through the freezer evaporator may thus be stopped. For instance, the compressor may be directed to an inactive state. Additionally or alternatively, the multi-path valve may be directed to close the branch path on which the freezer evaporator is disposed (e.g., in a first-branch-closed position). In some embodiments, the freezer cooling cycle is halted in response to the selected temperature being reached or detected (e.g., at the freezer temperature sensor), or in response to another set condition being determined, as would be understood.

At 330, the method 300 includes (e.g., optionally) directing a continued freezer airflow. In some embodiments, 330 follows or is in response to 320. Thus, although the freezer cooling cycle and the flow of refrigerant through the freezer evaporator has stopped, the freezer fan may be activated (or remain in an active state) to rotate and motivate the freezer airflow across the freezer evaporator or otherwise circulate through or within the freezer chamber. Optionally, the freezer fan may be rotated at a set or predetermined speed (e.g., in RPM) or according to a set volumetric flowrate (e.g., in cubic feet per minute).

At 340, the method 300 includes determining a freezer evaporator matches a freezer chamber. For instance, following the freezer cooling cycle (e.g., while the continued freezer airflow is being motivated), a temperature may be detected at the freezer evaporator (e.g., at an evaporator sensor thereof) and determined to match (e.g., be within a set temperature interval or percentage) from a temperature of the freezer chamber (e.g., detected at a chamber sensor thereof). In turn, the matching of temperatures between the freezer evaporator and freezer chamber may generally indicate the freezer evaporator—or refrigerant within the same—has sufficiently warmed or reached a state of relative equilibrium with the freezer chamber.

At 350, the method 300 includes halting the continued freezer airflow. In certain embodiments, 350 follows or is in response to 340. Thus, the freezer fan may be stopped or held in an inactive state to halt the freezer airflow.

At 360, the method 300 includes directing supplemental heat to a refrigerant loop. Specifically, supplemental heat may be directed to the refrigerant loop at a location between the condenser and the compressor (e.g., downstream from the compressor and upstream from the compressor relative to the default refrigerant flow path from the compressor and through the condenser, expansion device, and at least one evaporator). Optionally, 360 may follow 340 or 350. Thus, directing the freezer-chamber airflow across the freezer evaporator is prior to directing the supplemental heat.

In some embodiments, 360 includes directing a volume of refrigerant (e.g., as a hot refrigerant vapor) through a bypass line of the sealed system to bypass the condenser. For instance, as described above, at least a portion of refrigerant flowing from the compressor may be redirected to an alternative flow path defined by the bypass line that extends around (e.g., bypasses) the condenser before exhausting through a bypass outlet. Thus, relatively hot or high-temperature refrigerant may notably enter a downstream portion of the refrigerant loop without being cooled through the condenser. Optionally, directing the volume of refrigerant may include holding the bypass valve in an open position for a set time interval (e.g., continuously or according to a programmed pulse pattern). Additionally or alternatively, directing the volume of refrigerant may include measuring or detecting a predetermined bypass volume (e.g., at an optional flow sensor mounted along the bypass line or otherwise downstream from the bypass inlet). Thus, the sealed system may be prevented from over or under delivering hot refrigerant vapor apart from the condenser.

In additional or alternative embodiments, 360 includes activating an electric heating element along the refrigerant loop. For instance, as described above, the electric heating element mounted at the freezer evaporator may be activated to heat the same. As noted, the freezer evaporator may be disposed upstream of an outlet of the fresh food evaporator. Thus, refrigerant upstream of the outlet of the fresh food evaporator may be heated. Moreover, refrigerant migration may be prevented. Optionally, the electric heating element may be activated (e.g., continuously or according to a set duty cycle) for a set time interval. Additionally or alternatively, activation of the electric heating element may continue until a set heating threshold temperature is detected, such as at a temperature sensor mounted along the refrigerant loop (e.g., evaporator temperature sensor mounted on the freezer evaporator). Thus, the sealed system may be prevented from over or under heating refrigerant upstream of the outlet of the fresh food evaporator.

At 370, the method 300 includes directing a fresh food cooling cycle. For instance, the compressor may be activated to compress or motivate refrigerant along the refrigerant loop (e.g., to perform a cooling cycle as described above). During such activation, the multi-path valve may be directed to open the branch path on which the fresh food evaporator is disposed (e.g., in a second-branch-open position), thereby ensuring at least a portion of the refrigerant within the loop flows to and through the fresh food evaporator. Optionally, the fresh food-cooling cycle may occur, at least in part, during 360. Thus, for at least a portion of the fresh-food cooling cycle, the bypass valve may be opened to the bypass line (e.g., if present). Additionally or alternatively, the electric heating element may be directed to or held in an active state. Moreover, the fresh food fan may be activated to motivate air (e.g., as a fresh-food airflow) across the fresh food evaporator or otherwise circulate through or within the fresh food chamber. As would be understood, the fresh food cooling cycle may include one or more set parameters (e.g., targets or variable conditions), such as one or more compressor speeds, fan speeds, predetermined run times, etc. that the sealed system will use to execute the cooling cycle (e.g., in order to achieve a selected temperature within the fresh food chamber).

At 380, the method 300 includes halting the fresh food cooling cycle. In particular, the refrigerant flow through the fresh food evaporator may be halted. The active flow of refrigerant through the fresh food evaporator may thus be stopped. For instance, the compressor may be directed to an inactive state. Additionally or alternatively, the multi-path valve may be directed to close the branch path on which the fresh food evaporator is disposed (e.g., in a second-branch-closed position). In some embodiments, the fresh food cooling cycle is halted in response to the selected temperature being reached or detected (e.g., at the fresh food temperature sensor), or in response to another set condition being determined, as would be understood.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet comprising an internal liner defining a freezer chamber and a fresh food chamber;

a fresh food door attached to the cabinet to selectively restrict access to the fresh food chamber;

a freezer door attached to the cabinet to selectively restrict access to the freezer chamber; and a sealed refrigerant system comprising a refrigerant loop, a compressor disposed along the refrigerant loop, a condenser disposed along the refrigerant loop downstream from the compressor, a multi-path valve disposed along the refrigerant loop downstream from the condenser, a freezer evaporator mounted at the freezer chamber and disposed along a first branch path in selective fluid communication between the multi-path valve and the compressor, a fresh food evaporator mounted at the fresh food chamber and disposed along a second branch path in selective fluid communication between the multi-path valve and the compressor, a bypass valve disposed along the refrigerant loop in fluid communication between the compressor and the condenser, and a bypass line extending from a bypass inlet at the bypass valve to a bypass outlet disposed on the first branch and downstream from the condenser such that the bypass line is in fluid communication with the bypass valve to selectively direct a portion of refrigerant around the condenser.

2. The refrigeration appliance of claim 1, wherein the bypass outlet is disposed upstream from the freezer evaporator, bypassing the fresh food evaporator.

3. The refrigeration appliance of claim 1, wherein the bypass outlet is disposed downstream from the freezer evaporator, bypassing the fresh food evaporator.

4. The refrigeration appliance of claim 1, wherein the bypass outlet is disposed upstream from the freezer evaporator, and wherein the fresh food evaporator is disposed downstream from the bypass outlet.

5. The refrigeration appliance of claim 1, wherein the bypass outlet is disposed downstream from the freezer evaporator, and wherein the fresh food evaporator is disposed downstream from the bypass outlet.

6. The refrigeration appliance of claim 1, wherein the bypass outlet is disposed downstream from the fresh food evaporator, and wherein the freezer evaporator is disposed downstream from the bypass outlet.

7. The refrigeration appliance of claim 1, wherein the first branch path and the second branch path are mounted in fluid parallel upstream from the compressor.

8. The refrigeration appliance of claim 1, wherein the first branch path is disposed upstream from the fresh food evaporator.

9. The refrigeration appliance of claim 1, further comprising an electric heating element disposed on the freezer evaporator, the electric heating element being configured to selectively heat refrigerant at the freezer evaporator and thereby enable elevated refrigerant temperatures at the fresh food evaporator.

10. A refrigerator appliance comprising:

a cabinet comprising an internal liner defining a freezer chamber and a fresh food chamber;

a fresh food door attached to the cabinet to selectively restrict access to the fresh food chamber;

a freezer door attached to the cabinet to selectively restrict access to the freezer chamber; and a sealed refrigerant system comprising a refrigerant loop, a compressor disposed along the refrigerant loop, a condenser disposed along the refrigerant loop downstream from the compressor, a multi-path valve disposed along the refrigerant loop downstream from the condenser, a freezer evaporator mounted at the freezer chamber and disposed along a first branch path in selective fluid communication between the multi-path valve and the compressor, a fresh food evaporator mounted at the fresh food chamber and disposed along a second branch path and downstream from the first branch path in selective fluid communication between the multi-path valve and the compressor, a bypass valve disposed along the refrigerant loop in fluid communication between the compressor and the condenser, and a bypass line extending from a bypass inlet at the bypass valve to a bypass outlet disposed on the refrigerant loop downstream from the condenser such that the bypass line is in fluid communication with the bypass valve to selectively direct a portion of refrigerant around the condenser.

11. The refrigeration appliance of claim 10, wherein the bypass outlet is disposed along the first branch path upstream from the freezer evaporator, bypassing the fresh food evaporator.

12. The refrigeration appliance of claim 10, wherein the bypass outlet is disposed along the first branch path downstream from the freezer evaporator, bypassing the fresh food evaporator.

13. The refrigeration appliance of claim 10, wherein the bypass outlet is disposed along the first branch path upstream from the freezer evaporator, and wherein the fresh food evaporator is disposed downstream from the bypass outlet.

14. The refrigeration appliance of claim 10, wherein the bypass outlet is disposed along the first branch path downstream from the freezer evaporator, and wherein the fresh food evaporator is disposed downstream from the bypass outlet.

15. The refrigeration appliance of claim 10, wherein the bypass outlet is disposed downstream from the second branch path and the fresh food evaporator.

16. The refrigeration appliance of claim 10, wherein the bypass outlet is disposed along the first branch path downstream from the fresh food evaporator, and wherein the freezer evaporator is disposed downstream from the bypass outlet.

17. The refrigeration appliance of claim 10, wherein the first branch path and the second branch path are mounted in fluid parallel upstream from the compressor.

18. The refrigeration appliance of claim 10, further comprising an electric heating element disposed on the freezer evaporator, the electric heating element being configured to selectively heat refrigerant at the freezer evaporator and thereby enable elevated refrigerant temperatures at the fresh food evaporator.

* * * * *